US011053951B2

(12) United States Patent
Guidotti et al.

(10) Patent No.: US 11,053,951 B2
(45) Date of Patent: Jul. 6, 2021

(54) CENTRIFUGAL COMPRESSOR IMPELLER AND COMPRESSOR COMPRISING SAID IMPELLER

(71) Applicant: NUOVO PIGNONE TECNOLOGIE SRL, Florence (IT)

(72) Inventors: Emanuele Guidotti, Florence (IT); Dante Tommaso Rubino, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 192 days.

(21) Appl. No.: 15/573,973

(22) PCT Filed: May 12, 2016

(86) PCT No.: PCT/EP2016/060743

§ 371 (c)(1),
(2) Date: Nov. 14, 2017

(87) PCT Pub. No.: WO2016/184782

PCT Pub. Date: Nov. 24, 2016

(65) Prior Publication Data

US 2018/0291920 A1 Oct. 11, 2018

(30) Foreign Application Priority Data

May 15, 2015 (IT) ..... MI2015A000688

(51) Int. Cl.
*F04D 29/30* (2006.01)
*F04D 29/28* (2006.01)
(Continued)

(52) U.S. Cl.
CPC ..... *F04D 29/30* (2013.01); *F01D 5/141* (2013.01); *F01D 5/143* (2013.01); *F04D 17/12* (2013.01);
(Continued)

(58) Field of Classification Search
CPC ..... F04D 29/30; F04D 29/444; F04D 29/284; F04D 29/162; F04D 29/681; F04D 17/12; F01D 5/143; F01D 5/141; F05D 2220/40
See application file for complete search history.

(56) References Cited

U.S. PATENT DOCUMENTS 1,317,707 A * 10/1919 Johnson ..... F01D 5/20 416/228
1,862,827 A * 6/1932 Carnegie ..... F01D 5/146 416/224
(Continued)

FOREIGN PATENT DOCUMENTS

CN 1333153 C 8/2007
CN 104334854 A 2/2015
(Continued)

OTHER PUBLICATIONS

Sakamoto et al. JPS66602, May 20, 1980, English machine translation, specification (Year: 1980).*
(Continued)

*Primary Examiner* — David E Sosnowski
*Assistant Examiner* — Wayne A Lambert
(74) *Attorney, Agent, or Firm* — Baker Hughes Patent Organization

(57) ABSTRACT

A Centrifugal compressor impeller including a plurality of blades extending from a hub, each blade having a first wall defining a pressure side of the blade, and a second wall defining a suction side of the blade, and a free end defining a tip of the blade, the tip presenting a raised rim aligned to the first wall, the second wall of the blade being at least partially aligned with a surface of the tip free from the raised rim.

11 Claims, 2 Drawing Sheets

(51) Int. Cl.

| | |
|---|---|
| ***F01D 5/14*** | (2006.01) |
| ***F04D 29/68*** | (2006.01) |
| ***F04D 29/16*** | (2006.01) |
| ***F04D 17/12*** | (2006.01) |
| ***F04D 29/44*** | (2006.01) |

(52) U.S. Cl.
CPC ..... *F04D 29/162* (2013.01); *F04D 29/284* (2013.01); *F04D 29/444* (2013.01); *F04D 29/681* (2013.01); *F05D 2220/40* (2013.01)

(56) References Cited

U.S. PATENT DOCUMENTS

| | | | | | |
|---|---|---|---|---|---|
| 2,390,504 | A * | 12/1945 | Berger | F04D 29/681 | 415/198.1 |
| 2,925,952 | A * | 2/1960 | Alexander | F04D 29/444 | 415/208.3 |
| 3,824,029 | A * | 7/1974 | Fabri | F04D 29/288 | 415/109 |
| 3,893,787 | A * | 7/1975 | Jones | F04D 29/685 | 415/228 |
| 4,212,585 | A * | 7/1980 | Swarden | F04D 27/0215 | 415/198.1 |
| 4,274,806 | A * | 6/1981 | Gallardo, Jr. | F01D 5/20 | 415/173.1 |
| 4,613,281 | A * | 9/1986 | Lubieniecki | F16J 15/406 | 415/143 |
| 4,887,940 | A | 12/1989 | Todoroki et al. | | |
| 5,277,541 | A * | 1/1994 | Palmer | F04D 29/4213 | 415/206 |
| 5,456,576 | A * | 10/1995 | Lyon | F01D 5/20 | 415/173.3 |
| 5,476,363 | A * | 12/1995 | Freling | F01D 5/20 | 205/110 |
| 6,129,510 | A * | 10/2000 | Martin | F01D 5/043 | 123/559.1 |
| 6,832,890 | B2 * | 12/2004 | Booth | F01D 11/122 | 415/173.1 |
| 6,942,460 | B2 | 9/2005 | Osako et al. | | |
| 6,953,321 | B2 * | 10/2005 | Roudnev | F04D 7/045 | 415/197 |
| 7,946,825 | B2 * | 5/2011 | Tudor | F04D 29/384 | 416/223 A |
| 2013/0039773 | A1 * | 2/2013 | Funk | F01D 25/24 | 416/223 R |
| 2014/0286761 | A1 * | 9/2014 | Kim | F04D 29/162 | 415/173.1 |
| 2015/0086395 | A1 * | 3/2015 | Dextraze | F04D 29/4206 | 417/405 |
| 2015/0118079 | A1 * | 4/2015 | Dextraze | F01D 5/145 | 417/406 |
| 2015/0167696 | A1 * | 6/2015 | Mokulys | F04D 17/10 | 415/206 |

FOREIGN PATENT DOCUMENTS

| | | | | |
|---|---|---|---|---|
| DE | 10 2012 220 326 | A1 | 5/2014 | |
| JP | S55-66602 | A | 5/1980 | |
| JP | S59-185896 | A | 10/1984 | |
| JP | 59211795 | A * | 11/1984 | F04D 29/284 |
| JP | 08170598 | A | 7/1996 | |
| JP | 2010270732 | A | 12/2010 | |
| WO | 2013/162897 | A1 | 10/2013 | |

OTHER PUBLICATIONS

Search Report and Written Opinion issued in connection with corresponding IT Application No. 102015902352178 dated Feb. 3, 2016.

International Search Report and Written Opinion issued in connection with corresponding PCT Application No. PCT/EP2016/060743 dated Aug. 26, 2016.

International Preliminary Report on Patentability issued in connection with corresponding PCT Application No. PCT/EP2016/060743 dated Nov. 21, 2017.

Machine Translation and Copy of First Office Action and Search issued in connection with corresponding CN Application No. 201680028201.X dated Jan. 9, 2019.

* cited by examiner

CENTRIFUGAL COMPRESSOR IMPELLER AND COMPRESSOR COMPRISING SAID IMPELLER

FIELD OF INVENTION

Embodiments of the subject matter disclosed herein correspond to a centrifugal compressor impeller, and to a centrifugal compressor comprising said impeller.

BACKGROUND OF THE INVENTION

A turbomachinery, in particular a centrifugal compressor, may comprise a casing wherein a rotor is rotatingly supported. The rotor may comprise a rotor shaft supported by bearings and seals acting on the rotor shaft may be provided to isolate the interior of the compressor from the environment. In some embodiments, one or more impellers may be mounted on the shaft. The casing defines stator vanes, wherein impellers are positioned and may rotate. The casing (or stator) further defines stator conduits configured to collect the fluid leaving each impeller, and to feed the said fluid to the next compressor stage (if provided). Centrifugal compressors comprising a plurality of impellers are usually referred as multistage centrifugal compressor. Therefore, each impeller provides work to a compression stage.

An impeller may comprise a plurality of shaped blades extending from a hub. The hub and two adjacent blades form a shaped impeller vane.

In some embodiments, the impeller is open-faced (namely it is not shrouded) and each blade has a free end, that defines the tip of the blade. In those centrifugal compressor impellers, the tips of the blades are usually flat. When the impeller is mounted in the compressor the tips of the blades face the stator, and between the stator and the tip a gap is formed. As the compressed fluid may flow in the gap creating a recirculation in the compressor, the gap should be as small as possible in order to achieve a good stage performance.

This secondary fluid flow in the gap is usually called tip leakage flow. In order to reduce the tip leakage flow a recessed blade tip designs, having a U shaped cross section, was used to improve the total-to-total pressure ratio and efficiency over the whole operating range. As a result, the overall stage loss was reduced with recessed blade tip design due to the positive effect of the reduced tip leakage flow.

However, the recess cavity has an adverse effect on the stage efficiency due to the generation of a vortex in the cavity, hence generating additional losses.

Moreover, it is costly to form a U-shaped recess on the top of the tip, which may have a width in the order of 2-3 mm.

SUMMARY OF INVENTION

There is a general need for a centrifugal compressor impeller capable of giving a better stage compression performance.

An important idea is to provide a centrifugal compressor impeller having blades with a tip surface provided with a rim (also referred to as squealer tip) aligned to the pressure side of the blade, while the tip surface edge in correspondence of the suction side of the blade is almost completely free from said rim.

Embodiments of the subject matter disclosed herein correspond to a centrifugal compressor impeller.

Embodiments of the subject matter disclosed herein correspond to a centrifugal compressor comprising said impeller.

BRIEF DESCRIPTION OF DRAWINGS

The accompanying drawings, which are incorporated herein and constitute a part of the specification, illustrate exemplary embodiments of the present disclosure and, together with the detailed description, explain these embodiments. In the drawings.

DETAILED DESCRIPTION

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
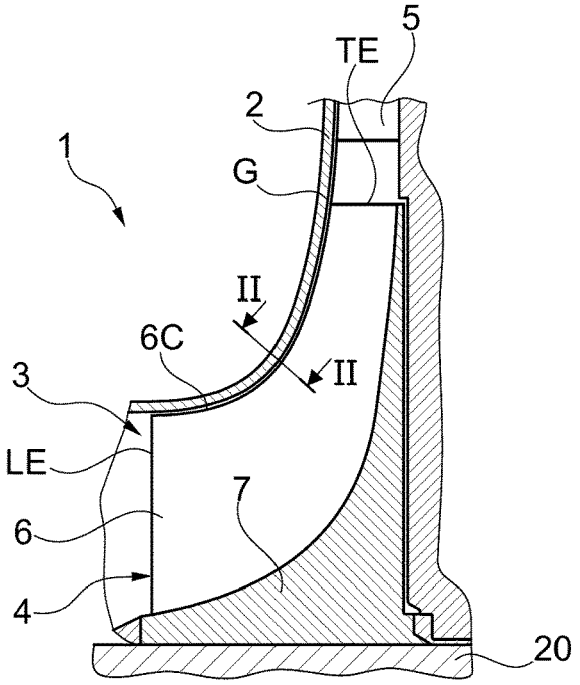
FIG. 1 shows a schematic and partial cross section of a centrifugal compressor according to the present disclosure.

FIG. 1 shows a centrifugal compressor 1, comprising a stator 2 defining at least a stator vane 3 wherein at least an open impeller 4 is mounted on a shaft 20. In the drawing, only one impeller is shown, but the centrifugal compressor may comprise a plurality of impellers mounted on the shaft 20, each defining a compressor stage. All the impellers or just some of them may be configured as described in the present description.

The stator 2 may be realized in a single piece or in different parts (diaphragms) mounted in a casing (not shown). The stator defines not only the vane 3 housing the impeller, but also one or more conduits 5 provided to collect a fluid leaving the impeller 4.

The centrifugal compressor impeller 4 comprises a plurality of blades 6, extending from a hub 7. Each blade 6 have a first wall 6A defining a pressure side of the blade (when the impeller is in operation), and a second wall 6B defining a suction side of the blade 6. Each blade further provides a free end defining a tip 6C of the blade. When the impeller is mounted on the centrifugal compressor the tip 6C of the blades faces the stator 2. A gap G is present between the stator and the tip.

Moreover, each blade 6 presents a leading edge LE provided at the inlet of the impeller, and a trailing edge TE provided at the outlet of the impeller.

According to one aspect of the disclosure the tip 6C presents a raised rim 8 aligned (see FIG. 2) to the first wall 6A. A free edge of the second wall 6B of the blade, instead, is at least partially aligned with a surface 6D of the tip 6C free from the raised rim 8.

Figure 2:
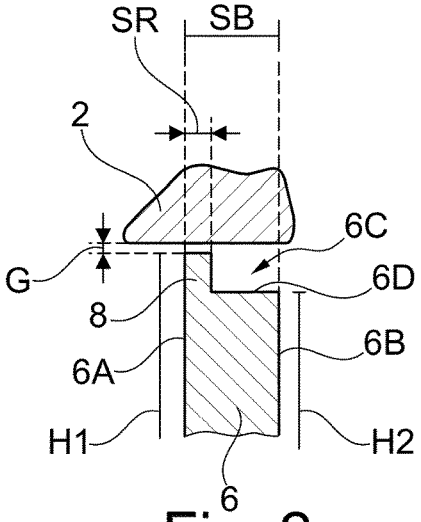
FIG. 2 shows a schematic section taken along section line II-II of FIG. 1 and II-II of FIG. 3.

As it may be clear form FIG. 2, in the same cross section taken where the second wall is free from said rim, the height H1 of the first wall is bigger than the height H2 of the second wall. The ratio between the blade tip width SB and the rim width SR (SB/SR) in any section (FIG. 2) may be higher than 2, depending on the blade tip thickness. The second wall 6B of the blade 6 may be completely aligned (for all its length L) with the surface 6D of the tip free from said raised rim 8.

Figure 3:
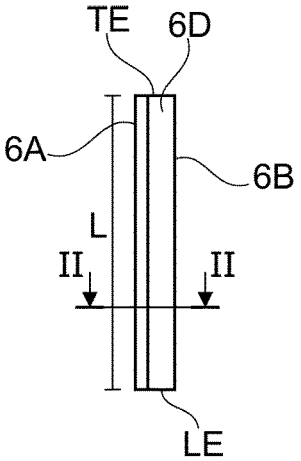
FIG. 3 shows a top view of a tip surface of the blade represented in FIG. 2.

FIG. 3 shows that the raised rim 8 extends for all the length L of the first wall.

Figure 4:
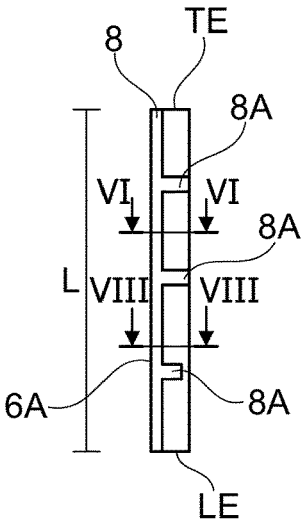
FIGS. 4 and 5 show alternative designs of a blade tip surface according to the present disclosure.
Figure 5:
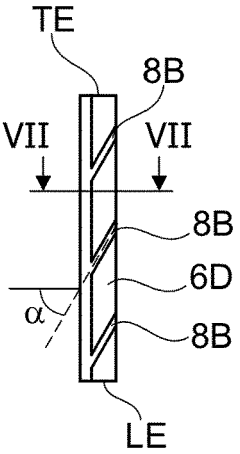

Other configuration of the blade tip may be provided, for example, as shown in FIGS. 4 and 5.

In the description of this embodiment, those parts functionally similar to the ones already described will be indicated with the same reference numbers, and their description will be omitted.

Figure 6:
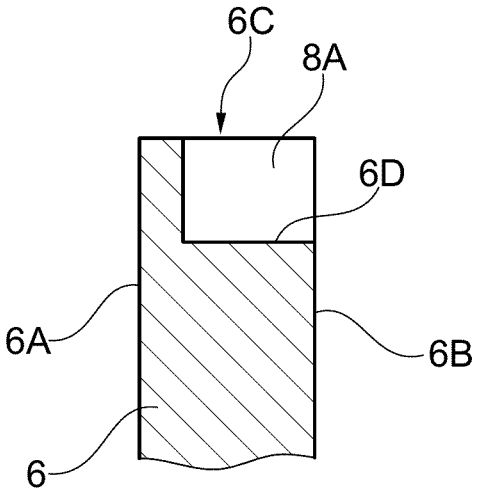
FIGS. 6, 7 and 8 show cross sections taken respectively on section lines VI-VI of FIG. 4, VII-VII of FIG. 5 and VIII-VIII of FIG. 4.
Figure 7:
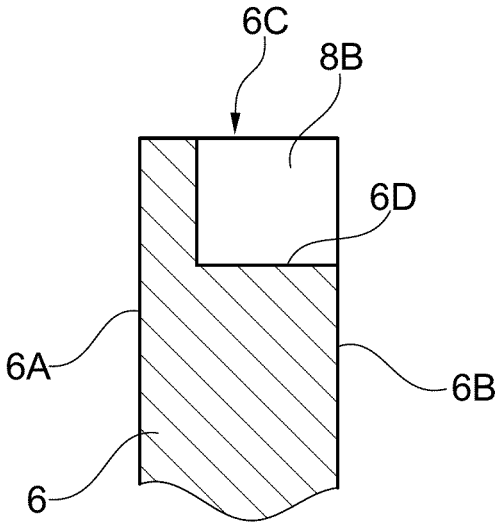
Figure 8:
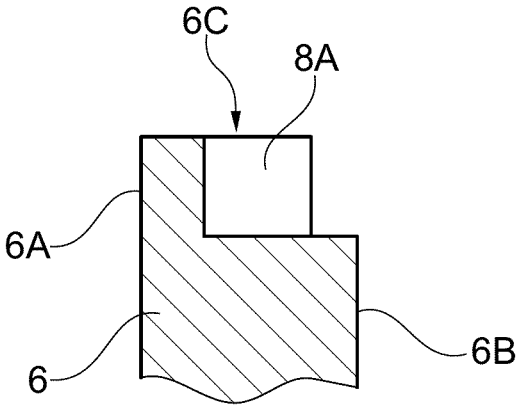

FIG. 4 shows a blade tip, having a raised rim 8 very similar form the one above described. The raised rim 8 is also provided with one or more parts 8A extending form it in the direction of the second wall 6B. Said parts 8A may extend up to the second wall 6B, as shown in FIG. 6, or may be distant from the wall 6B (FIG. 8).

The parts 8A, may extend in a direction that is perpendicular to the first wall 8A, when seen in a top view as the one of FIG. 4.

Also in FIG. 5 the raised rim is similar to the one of FIG. 3, but it provides parts 8B that extend from the rim in a direction that is inclined with respect to the first wall 8A. The inclination may be the same for all the parts 8B, or each or some of the parts may have a different inclination with respect to the first wall 6A. The parts 8B may extend up to the second wall 6B or may be distant from it (even if this solution is not represented in the drawings). In the top view of FIG. 5, the inclination $\alpha$ of the axis of the parts 8A with respect to the first wall 6A can be appreciated; the inclination $\alpha$ may be comprised between −45° and +45°.

The presence of the rim 8A, and if present, of the parts 8A or 8B extending form the rim, may reduce leakage flows due to the development of dissipative vortices that may increase stage efficiency.

Furthermore, an operating range extension due to the reduction of tip leakage flow interaction with main flow at highest pressure ratios (towards left limit) may be achieved.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A centrifugal compressor impeller comprising:
a hub; and
a plurality of blades extending from the hub, each blade of the plurality of blades comprising:
a first wall defining a pressure side;
a second wall defining a suction side; and
a free end defining a blade tip, the blade tip comprising a tip surface at least partially aligned with an edge of the second wall and extending from the edge of the second wall to a raised rim, the raised rim in alignment with an edge of the first wall and raised relative to the tip surface, the raised rim comprising a plurality of parts spaced away from each other, each part of the plurality of parts extending a respective length from the raised rim in a direction perpendicular to the first wall and toward the second wall, the plurality of parts being raised relative to the tip surface, at least one of the plurality of parts extending to the second wall and at least one of the plurality of parts extending to a point distant from the second wall.

2. A centrifugal compressor comprising:
an impeller comprising a plurality of blades extending from a hub, each blade of the plurality of blades comprising:
a first wall defining a pressure side;
a second wall defining a suction side; and
a free end defining a blade tip, the blade tip comprising a tip surface at least partially aligned with an edge of the second wall and extending from the edge of the second wall to a raised rim, the raised rim in alignment with an edge of the first wall and raised relative to the tip surface, the raised rim comprising a plurality of parts spaced away from each other, each part of the plurality of parts extending a respective length from the raised rim in a direction perpendicular to the first wall and toward the second wall, the plurality of parts being raised relative to the tip surface, at least one of the plurality of parts extending to the second wall and at least one of the plurality of parts extending to a point distant from the second wall; and
a stator comprising a stator vane within which at least the impeller is positioned, and at least a stator conduit to collect a fluid leaving the impeller.

3. The centrifugal compressor according to claim 2, wherein the compressor comprises a plurality of impellers and a plurality of stator conduits to collect the fluid leaving an impeller of the plurality of impellers and feeding the fluid to an adjacent impeller of the plurality of impellers.

4. The centrifugal compressor according to claim 2, where the blade tip of each of the plurality of blades faces the stator.

5. The centrifugal compressor according to claim 2, wherein the plurality of parts is a plurality of spaced apart walls extending laterally from the raised rim toward the second wall.

6. A centrifugal compressor impeller comprising:
a hub; and
a plurality of blades extending from the hub, each blade of the plurality of blades comprising:
a first wall defining a pressure side;
a second wall defining a suction side; and
a free end defining a blade tip, the blade tip comprising a tip surface at least partially aligned with an edge of the second wall and extending from the edge of the second wall to a raised rim, the raised rim in alignment with an edge of the first wall and raised relative to the tip surface, the raised rim comprising a plurality of parts spaced away from each other, each part of the plurality of parts extending a respective length from the raised rim in a direction toward the second wall, the plurality of parts being raised relative to the tip surface, at least one of the plurality of parts extending to the second wall and at least one of the plurality of parts extending to a point distant from the second wall.

7. The centrifugal compressor impeller according to claim 6, wherein the raised rim extends lengthwise along the entirety of the first wall.

8. The centrifugal compressor impeller according to claim 6, wherein the second wall of each blade of the plurality of blades is aligned with the tip surface.

9. The centrifugal compressor impeller according to claim 6, wherein each of the plurality of parts extends from the rim in a direction inclined with respect to the first wall.

10. The centrifugal compressor impeller according to claim 6, wherein each of the plurality of parts extends up to the second wall.

11. The centrifugal compressor impeller according to claim 6, wherein the plurality of parts is a plurality of spaced apart walls extending laterally from the raised rim toward the second wall.

* * * * *